United States Patent [19]

Fedoryshyn

[11] Patent Number: 4,492,309

[45] Date of Patent: Jan. 8, 1985

[54] MULTIPLE-OBJECTS SUPPORT RACK

[76] Inventor: Nicholas R. Fedoryshyn, 14 Evelyn La., Syosset, N.Y. 11791

[21] Appl. No.: 386,925

[22] Filed: Jun. 10, 1982

[51] Int. Cl.[3] ..... A47F 7/00

[52] U.S. Cl. ..... 211/65; 211/89; 248/113; 411/343; 411/346; D6/534

[58] Field of Search ..... 211/65, 89, 66, 65, 211/60 T, 60 R, 87; 411/343, 346; D6/93, 94; 248/110, 113, 221.4, 73, 221.3, 342, 343; 52/38

[56] References Cited

U.S. PATENT DOCUMENTS

| | | | |
|---|---|---|---|
| 1,794,638 | 3/1931 | Meuller | 248/211.4 X |
| 2,707,052 | 4/1955 | Brown | 211/89 X |
| 2,708,523 | 5/1955 | Rozanski | 211/89 |
| 2,889,451 | 6/1959 | Longo | 211/87 X |
| 3,138,414 | 6/1964 | La Pollo | 211/65 X |
| 3,343,683 | 9/1967 | Wheeler | 211/89 |
| 3,343,684 | 9/1967 | Galier | 211/89 |
| 3,946,877 | 3/1976 | Galicia | 211/89 X |
| 3,946,878 | 3/1976 | Stoveken et al. | 211/89 X |

*Primary Examiner*—Robert W. Gibson, Jr.

*Attorney, Agent, or Firm*—Posnack, Roberts, Cohen & Spiecens

[57] ABSTRACT

Apparatus is provided for temporarily supporting objects such as toothbrushes. The apparatus includes an anchor part which may be affixed to a supporting structure such as a wall. A detachable section is detachably coupled to the anchor part and is in the form of a bracket including two spaced arms between which extend a pair of spaced parallel rods on which are supported a plurality of clamps having a clothespin-like configuration. The clamps are spaced from one another by sleeves and are provided with elongated openings through which the aforegoing rods extend. These clamps are held by the rods in rectilinear alignment and are color coded in order to be identified with specific objects which are engaged therein.

8 Claims, 5 Drawing Figures

MULTIPLE-OBJECTS SUPPORT RACK

FIELD OF INVENTION

This invention relates to supports for objects of various types and, in particular, to support racks for pluralities of objects such as toothbrushes.

BACKGROUND

While the present invention is concerned with providing supports for various types of objects, it is particularly concerned with the solution of problems in connection with dental hygiene in institutional organizations. In such institutional organizations there is a need for inexpensive and sanitary toothbrush racks, which can be used in different wards. The rack required in such environment should be inexpensive and easily produced and should be utilizable without the need for specialized personal or attendant equipment. The parts of the same should be easily replaceable and each rack should be able to identify with a specific group of patients or an area in the ward and should be able to function to isolate those with contagious diseases. The rack, moreover, should be easily transportable and readily cleaned or sterilized and its design should be capable of simple handling and cleaning.

In addition to the above, the parts of the rack should be easily replaceable so that when they become broken or damaged, no significant problem will be encountered. Moreover, the rack should accept various shapes of objects so that it will not be necessary to standardize the objects to be accommodated within the same. In addition, the rack should provide some way to identify the specific object or person associated therewith for the purpose of possibly isolating the same whereby to avoid the problems of contagious diseases.

Still further, the rack should be open to provide for air drying and should be of sufficient dimension to avoid contact between the supported toothbrushes or other such objects thereby to minimize cross-contamination.

With respect to supports and protectors for toothbrushes, these fall generally into two categories, namely: one type of support which is affixed to the wall and provides openings within which respective toothbrushes may be supported and a second type which clamps on to the head of the toothbrush and is transportable therewith. Neither of these types of supports will supply the various features and advantages which have been heretofore identified. For example, the type of rack which permanently affixes to the wall does not admit of transportation and sanitizing of the rack substantially as a whole. The type of enclosure which fits over the head of a toothbrush and is transportable therewith does not provide for group support of toothbrushes and becomes in a sense permanently associated with a toothbrush so that it may not be employed for the sequential accommodation of toothbrushes belonging to different patients.

SUMMARY OF INVENTION

It is an object of the invention to provide an improved multiple-object support rack which can be economically produced and the parts of which may be readily replaced.

It is an object of the invention to provide furthermore a support rack of the above-identified type which can be detachably supported on a wall or other such supporting structure in such a manner, that it is readily detached for cleaning and sterilization and whose design is consistent with the goals of easy handling and cleaning.

Yet another object of the invention is to provide an improved support rack, especially suitable for use with the toothbrushes of patients in an institutionalized type of environment.

Still another object of the invention is to provide an improved multiple-object support rack which will readily accommodate many types of shapes and designs or sizes of objects.

Yet a further object of the invention is to provide an improved rack, the supporting parts of which may be readily color coded in order to provide for the isolation of different types of contagious diseases.

Still another object of the invention is to provide an improved rack wherein the objects supported thereby are readily spaced from one another to the necessary extent to minimize contact between the supported objects and thereby the minimizing of cross-contamination in hospital-type institutions and the like, while providing for air-drying of the supported objects.

In achieving the above and other objects of the invention, there is provided an apparatus in the form of a multiple-object support rack. This apparatus preferably comprises a support means and a plurality of clamps on the said support means for the respective engagement of the objects which may, for example, be constituted by toothbrushes as has been indicated above. The clamps each include clamping members and springs operatively associated with these members for resiliently urging them towards one another. The clamps are preferably arranged in spaced rectilinear alignment. Moreover, the support means will, in accordance with the invention, include an anchor for being connected to the supporting structure which, for example, may be the wall of a hospital ward or the like and a detachable part which is detachably coupled with the anchor to support the clamps thereon. The clamps, in accordance with a preferred embodiment of the invention, are clothespin-like structures.

In accordance with more specific features of the invention, the support means preferably comprises a bracket including spaced arms and spaced parallel rods extending between and supported by these arms. The rods extend through and support the clamps. In accordance with still another feature of the invention, spacers are provided on the rods to be positioned between the clamps and to space the same. These spacers may preferably be in the form of cylindrical sleeves which engage and are supported on at least one of the rods to prevent the clamps from moving towards one another.

A further, more detailed, feature of the invention involves the use of snap buttons including sections or parts respectively attached to the aforesaid anchor and detachable section of the support, whereby these parts are snappingly engaged.

Another specific feature finds the rods including ends which extend through the aforesaid arms there being provided means such as cotter pins engaging the ends to lock the rods to the arms.

The clamps are provided with elongated openings through which the rods pass. Furthermore these clamps are preferably color coded to relate to specific of the objects such as, for example, to identify contagious diseases as, for example, toothbrushes belonging to patients who have contracted hepatitis or the like.

The above and other objects, features and advantages of the invention will be found in the detailed description which follows hereinafter, as illustrated in the accompanying drawing.

DETAILED DESCRIPTION

Figure 1:
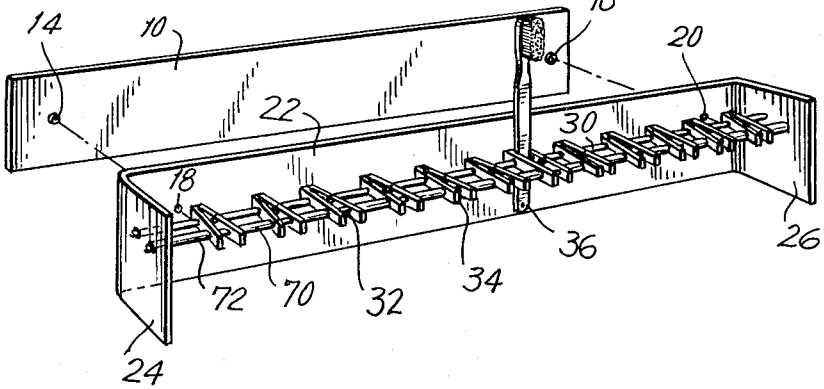
FIG. 1 is an exploded perspective view of a multiple-object support rack provided in accordance with the invention.

As is shown in FIG. 1, the rack of the invention includes an anchor part 10 and a detachable part 12, these two main parts constituting the basic parts of a multiple-object support rack provided in accordance with the invention.

Figure 2:
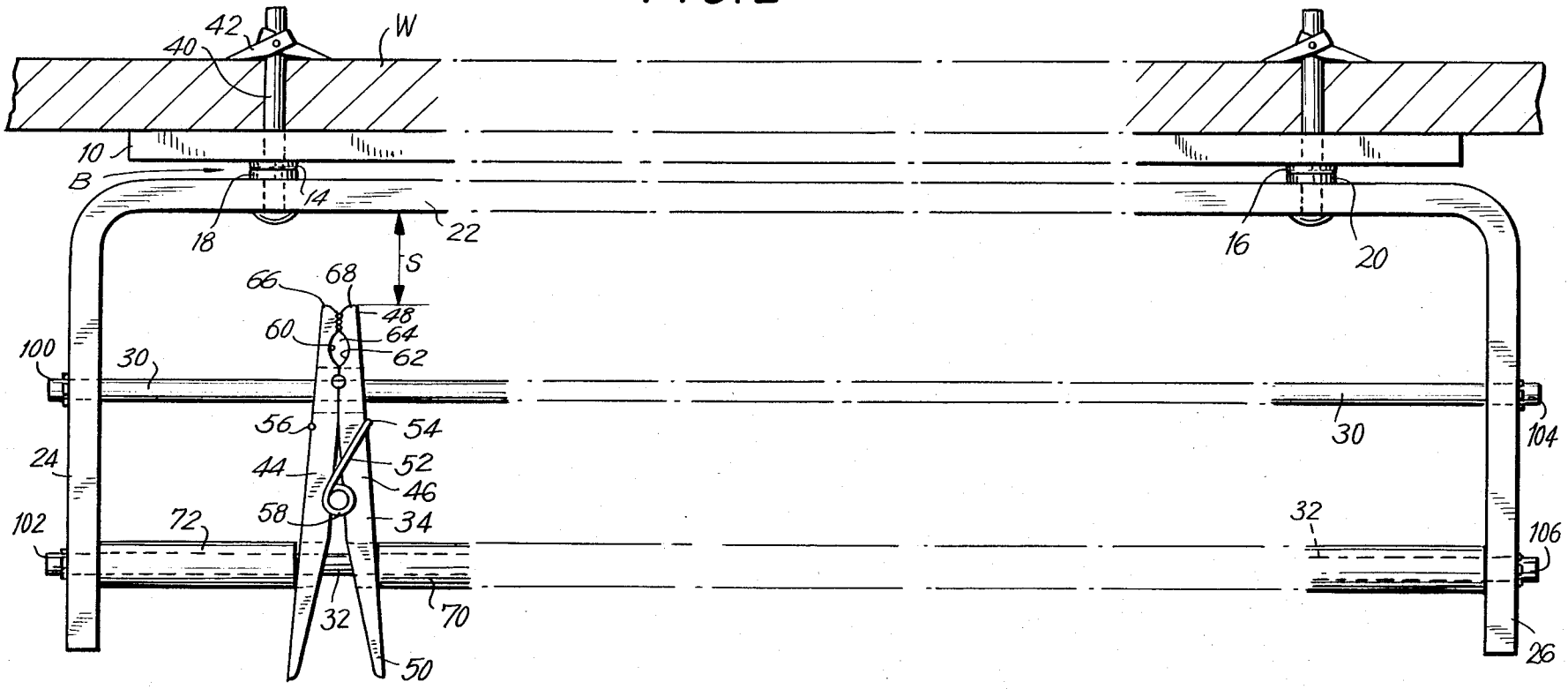
FIG. 2 is a fragmentary top view partially in section illustrating on enlarged scale various elements of the support rack of FIG. 1.

The anchor 10 is intended for installation on a wall or other such supporting structure, such as indicated at W in FIG. 2. Anchor 10 is, moreover, provided with parts of snap buttons which are indicated, for example, at 14 and 16. The counterparts of these button sections are indicated at 18 and 20. The details of these connecting elements will be described in detail hereinbelow.

The detachable section 12 includes a wall 22 intended to be placed in face-to-face relationship with the anchor 10. Both of these sections being flat, planar sections of generally rectilinear conformation and of rectangular shape.

The wall 22 has two arms 24 and 26 extending orthogonally therefrom. The arms 24 and 26 are preferably monolithic with the wall 22 and are of square or rectangular shape. The parts 10 and 12 may be fabricated of a material such as plastic, chrome steel or porcelain, but may, indeed, be any material suitable for being readily cleaned and sterilized, such as by being dipped into a sterilizing solution which may be of elevated temperature or otherwise. Preferably the material is consistent with the economy goals of the invention and will be of a type which is readily shaped and otherwise made a part of the support rack of the invention, without adding substantially to the cost thereof.

Between the arms extend two parallel rods 30 and 32. These rods are preferably fabricated of steel or the like. They extend through the arms 24 and 26 between which they are supported. The function of these rods is to hold in position a plurality of clamps, such as are generally indicated at 34 and the details of which will next be explained relative to FIG. 2. Supported in one such clamp 34 is an object, such as a conventional toothbrush, indicated at 36.

In FIG. 2 is illustrated the above-noted supporting structure W and a snap button B consisting, for example, of the parts 14 and 18 noted hereinabove.

Also illustrated in FIG. 2 are the arms 24 and 26 with rods 30 and 32 extending therebetween.

The rods 30 and 32 are preferably arranged in parallel as has already been noted. They extend through and support the clamps 34. The rods 30 and 32 may be, for example, of a diameter of about $\frac{1}{8}$ to $\frac{1}{4}$ of an inch. These dimensions are given by way of example only, as this range can be readily exceeded while nevertheless coming within the requirements of the invention. Similarly, the arms 24 and 26, as well as the connecting wall 22, may have corresponding or identical thicknesses in the order of magnitude of $\frac{1}{8}$ to $\frac{1}{4}$ of an inch, it being noted that this dimensional range can also be exceeded or otherwise varied within the scope and requirements of the invention.

FIG. 2 illustrates that the button construction B may conveniently be adapted for ready installation on the wall W. Thus, for example, the section 14 of the snap button B, which snappingly engages the section 18, may be provided with an extended pin 40 which is of a length adapted to extend not only through the thickness of the anchor 10, but also to extend through the thickness of the wall W. The pin 40 will be provided with a moly bolt construction 42 which enables the anchor 10 to be readily mounted on and supported by the wall W. This arrangement will also true at the other end of the anchor 10 whereat is located the button section 16.

It is more clearly shown in FIG. 2 that each of the clamps 34 is preferably in the conformation of a clothespin-type design. It includes members 44 and 46 which are of a substantial longitudinal extent. This longitudinal extent, which may be of the order of, for example, 2 to 3 inches, enables the clamping end 48 to remain remote from the manually manipulated end 50 thereby to isolate the hands of the manipulator from the objects to remain in sanitized isolation at the clamping end 48.

Parts 44 and 46 are held together by a spring member 52. This spring member includes a portion 54 and a portion 56 between which the two clamp parts 44 and 46 are constrained against one another. The spring 52, moreover, includes a coil portion 58 which acts as a fulcrum upon which the two members 44 and 46 can be pivoted. Thus, the two members 44 and 46 are resiliently urged against one another by the spring 52 and are furthermore held in position by the same. Members 44 and 46 are furthermore provided with matching and facing concavities 60 and 62 which cooperatively constitute an opening 64 in which an object such as a toothbrush may be engaged and supported. Moreover, the distal ends 66 and 68 of the members 44 and 46 are preferably spaced from the wall 22 of the support rack by a distance S which is preferably in the order of a minimum of a quarter of an inch and preferably greater than one half of an inch in order that the toothbrushes or other such objects may be readily inserted into the respective clamps 34 without coming into contact without any of the surrounding parts, which may be temporarily germ-laden or otherwise desanitized.

The various clamps may, in accordance with the invention, be color coded. Thus, for example, one or more of the clothespins may be colored green, while other of the clothespins may be colored orange, yellow and/or red. This color may be integral with the material from which the clamps are fabricated, this material preferably being a suitable plastic. It has also been noted hereinabove that the clamps are spaced from one another. This is accomplished by the utilization of sleeves, such as illustrated, by way of example, at 70 and 72.

These sleeves are preferably of cylindrical conformation and slide onto and are supported on the associated rod. In the illustrated embodiment, the sleeves are supported only on the rod 32 and this is preferred since the corresponding ends of the clamps are urged from a position of maximum spacing to a position of minimal spacing, whereas the opposite ends of the clamp move in reverse direction and would require the use of sleeves of a resilient or yieldable type. It should be noted that the use of such sleeves 70, 72 enables the spacing between the clamps to be readily changed. Thus, for example, the sleeves 70, 72 which may be in the illustrated embodiment of a length of, for example ¼ to ½ of an inch, may be replaced by sleeves which will be in a range of ½ of an inch to 1½ inches. Other substitutions are also possible within the scope of the invention. These sleeves may be, for example, of aluminum or steel or rubber or the like, but should have sufficient rigidity so as to be able to retain the clamps at a desired minimum spacing whereby possibility of contacts between neighboring objects will be minimized.

Figure 3:
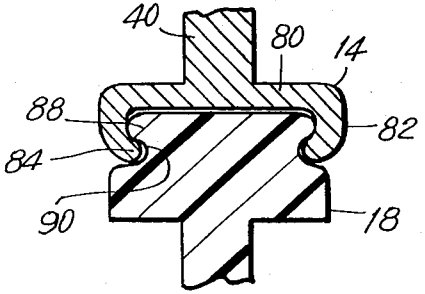
FIG. 3 is a view on enlarged scale and partially in section, illustrating the snap button details employed to hold together the parts of of the rack for detachable disconnection.

FIG. 3 illustrates the details of the snap button connectors utilized to connect part 12 to part 10 of the support rack of the invention. In FIG. 3 appear, by way of example, button sections 14 and 18. Section 14 includes a pin or post 40 mentioned hereinabove, which is of a length to perform the function which has already been specified, notably that of extending through the anchor 10 and the wall W to accommodate a moly bolt connector at the end thereof. The section 14 is provided with a base 80 and a cylindrical wall 82 with an inturned annular flange 84 to define a narrowed opening. Part 18 is provided with a base section 86 and a head 88 between which is defined an annular groove 90 which accommodates the flange 84. The material from which the section 14 is fabricated provides for a certain resilience, whereby the part 88 may be inserted into the receiving chamber in a snapping engagement whereafter the two parts are detachably held together. The type of material from which the part 14 is fabricated will, morever, enable a large number of repeated insertion and detachments of the part 88 so that the detachable section 12 may be repeatedly and frequently installed onto and removed from the anchor 10. Such a suitable material may, for example, be beryllium copper, although a large number of other materials are also known for this purpose.

Figure 4:
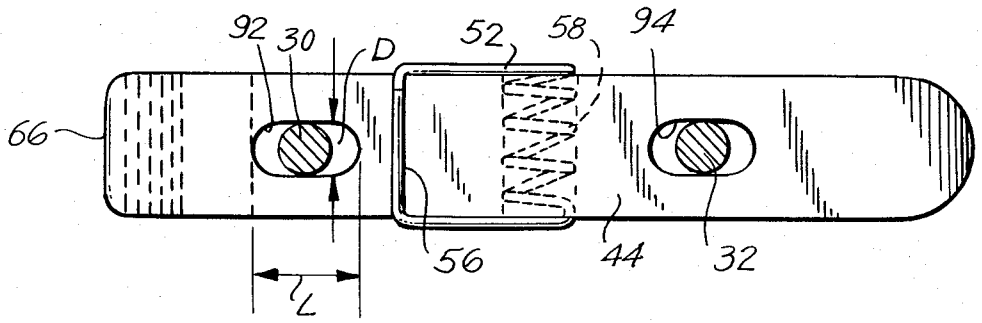
FIG. 4 is a side view of a clamp utilized in the rack of FIGS. 1 and 2, this view illustrating the enlarged openings provided therein.

FIG. 4 is a side view of one of the clothespin-like clamps of the invention showing, for example, member 44 and spring 52 with restraining arm 56. Also shown in this Figure are rods 30 and 32 received within accommodating openings 92 and 94 extending through both members of the clamp 34, which is illustrated by way of example. The openings or slots 92 and 94 have widths D and lengths L. These dimensions are generally so related that the lengths are approximately about two times the magnitude of the associated widths. This feature enables the installation to accommodate the pivot-like movement of the members 44 and 46 towards and away from one another without causing a binding on the associated rods. Accordingly, the elongated slots constitute a preferred version of the slots which will be provided in accordance with the invention.

Figure 5:
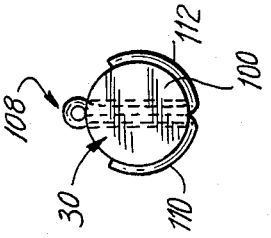
FIG. 5 is an end view of the rods employed in the rack of FIGS. 1 and 2 with the locking device installed therein to prevent detachment of the rods.

FIG. 5 illustrates by way of example the rod 30. Rod 32 will also include an end which is locked to the associated arm in a similar manner. The ends of the rods are seen, by way of example, in FIG. 2 at 100, 102, 104 and 106. The end 100 appears in FIG. 5. Thereupon is shown the locking member 108, which may preferably be in the form of a cotter pin extending through a hole provided in diametral relationship through and in the end 100. The cotter pin consists of two arms 110 and 112, which are extended through the hole in the end 100 and are bent in reversed direction around the same to conform to the shape of the end and thereby to function to lock the rod 30 onto the member 12, when operating in association with the cotter pin or locking member provided at the opposite end of the rod.

From what has been stated above, it will now appear that the invention provides for a support rack which is preferably fashioned in two parts, one of which may be more or less permanently anchored to a supporting structure such as a wall, whereas the other part is detachable and readily removed for transportation to a remote zone at which sanitation of this part and the various elements included in the same may take place. The invention also provides for the support of a plurality of rectilinear aligned clamps generally and preferably in the form of a clothespin-like structure into which objects, such as toothbrushes may be readily inserted and from which these objects may be readily removed. It will follow as a natural consequence of the structure of the invention, as has been described above, that this structure is economically fashioned and readily dealt with by persons of various levels of mechanical ability. Similarly it will be seen that the parts of the support rack of the invention are readily replaced, as well as economically manufactured and assembled.

There will now be obvious to those skilled in the art many modifications and variations of the structure which has been described above. These modifications and variations will not depart from the scope of the invention if defined by the following claims. Thus, for example, the clamps, which have been illustrated as being installed with the object engaging ends thereof towards the wall 22, may be mounted in reverse direction with these object engaging ends extending outwardly from the wall 22 in a reverse posture from that which has been illustrated.

What is claimed is:

1. Apparatus for the support of a plurality of objects on a supporting structure, said apparatus comprising a support means and a plurality of clamps on said support means for the respective engagement of said objects, said clamps each including clamping members and spring means operatively associated with said members for resiliently urging one of the members towards the other of said members, said clamps being arranged in spaced rectilinear alignment and being clothespin-like structures, said support means including an anchor means for being connected to said supporting structure and detachable means detachably coupled with said anchor means to support said clamps thereon, said support means comprising a bracket including spaced arms and two spaced rods extending in parallel between and supported by said arms, said rods extending through and supporting said clamps; and spacers on said rods between said clamps to space the latter, said clamps being provided with elongated openings through which said rods pass.

2. Apparatus as claimed in claim 1, said support means comprising snap buttons including parts respectively attached to said anchor means and to said detachable means, said parts being snappingly engageable.

3. Apparatus as claimed in claim 1, wherein said rods include ends which extend through said arms, comprising means on said ends to lock the rods to said arms.

4. Apparatus as claimed in claim 1, wherein said spacers are sleeves on at least one of said rods.

5. Apparatus as claimed in claim 1, wherein the clamps are color coded to relate to specific of the objects.

6. Apparatus as claimed in claim 1, wherein the elongated openings have a length of a magnitude of about twice the width thereof.

7. Apparatus as claimed in claim 1, wherein the clamps are spaced from said bracket by at least about a quarter of an inch.

8. Apparatus as claimed in claim 2, wherein one of the parts of the button includes an extended pin and moly bolt connection on the pin.

* * * * *